US006064146A

United States Patent [19]

Lee

[11] Patent Number: 6,064,146

[45] Date of Patent: May 16, 2000

[54] SHADOW MASK FRAME ASSEMBLY FOR COLOR CATHODE RAY TUBE

[75] Inventor: Sun-heang Lee, Suwon, Rep. of Korea

[73] Assignee: Samsung Display Devices Co., Ltd., Kyungki-do, Rep. of Korea

[21] Appl. No.: 09/103,463

[22] Filed: Jun. 24, 1998

[30] Foreign Application Priority Data

Jul. 4, 1997 [KR] Rep. of Korea ..... 97-31142

[51] Int. Cl.[7] ..... H01J 29/07

[52] U.S. Cl. ..... 313/407; 313/402

[58] Field of Search ..... 313/402, 403, 313/407; 445/30

[56] References Cited

U.S. PATENT DOCUMENTS

| | | | |
|---|---|---|---|
| 4,056,755 | 11/1977 | Sohn | 313/402 |
| 4,599,533 | 7/1986 | Ragland, Jr. | 313/407 |
| 4,712,041 | 12/1987 | Greiner et al. | 313/407 |
| 5,416,380 | 5/1995 | Horiuchi | 313/407 |
| 5,929,558 | 7/1999 | Lee | 313/402 |

*Primary Examiner*—Michael H. Day
*Attorney, Agent, or Firm*—Leydig, Voit & Mayer

[57] ABSTRACT

A shadow mask frame assembly for a color cathode ray tube including a plate shaped shadow mask (60) including electron beam passing holes (H) and having a curvature, and a frame (70) having a side wall (73), a flange (72) inwardly extending from the side wall (73), and a supporting portion (71) extending from the flange (72) as a step, wherein some peripheral edges (61) of the shadow mask (60) are attached to the supporting portion (71) and some peripheral edges (61) of the shadow mask (60) are not attached to the supporting portion (71) and slip on an upper surface of the supporting portion (71) during thermal expansion of the shadow mask (60). The present shadow mask frame assembly can be easily fabricated and assembled by eliminating the skirt portion, and can effectively compensate for thermal expansion of the mask plate.

3 Claims, 4 Drawing Sheets

SHADOW MASK FRAME ASSEMBLY FOR COLOR CATHODE RAY TUBE

BACKGROUND OF THE INVENTION

1. Field of the Invention

The present invention relates to a color cathode ray tube, and more particularly, to a shadow mask frame assembly which allows an electron beam emitted from an electron gun to be scanned on a fluorescent film accurately.

2. Description of the Related Art

Referring to FIG. 1 showing a conventional color cathode ray tube (CRT), a fluorescent film 11 is formed on the inner side of a panel 10, and a shadow mask frame assembly 20 is spaced a predetermined distance from the fluorescent film 11. The shadow mask frame assembly 20 is constituted by a shadow mask 21 facing the fluorescent film 11 and a frame 22 for supporting the shadow mask 21. The panel 10 is adhered to a funnel 30 comprising a neck portion 31 having an electron gun 40 mounted therein and a cone portion 32 having a deflection yoke 50.

The shadow mask 21, as shown in FIG. 2, includes a mask plate 21*a* having a plurality of electron beam passing holes H, a rim 21*b* extending from the periphery of the mask plate 21*a,* a skirt portion 21*c* extending downwardly from the rim 21*b* at a right angle. The frame 22 includes a supporting wall 22*a* to which the skirt portion 21*c* of the shadow mask 21 is welded for support, and a flange 22*b* inwardly extending from the supporting wall 22*a*.

The electron beams emitted from the electron gun 40 mounted in the neck portion 31 (see FIG. 1) are selectively deflected by the deflection yoke 50 and pass through the electron beam passing holes H of the shadow mask 21 to land on the fluorescent film 11 so that phosphors are excited.

Only about 15~30% of the electron beams emitted from the electron gun 40, that is, thermions, pass through the electron beam passing holes H of the shadow mask 21. The remaining electron beams impinge on the mask plate 21*a* of the shadow mask 21 so that the shadow mask 21 and the frame 22 supporting the shadow mask are heated so that they are thermally expanded.

When the shadow mask 21 and the frame 22 are thermally expanded, since their thermal expansion coefficients are different from each other, the radius of curvature of the mask plate 21*a* changes over time. That is to say, in the beginning stage of operating the CRT, the shadow mask 21 is heated, and expands prior to the frame 22, so that the radius of curvature of the mask plate 21*a* becomes smaller, which is called a doming phenomenon. As time passes, the frame 22 is thermally expanded so that the radius of curvature of the mask plate 21*a* increases again.

To reduce the doming phenomenon due to thermal expansion of the shadow mask 21, conventionally, a buffer groove 21*d* is formed on the rim 21*b* of the shadow mask 21 to compensate for the expansion of the mask plate 21*a,* or the radius of curvature of the shadow mask 21 is made larger.

However, since the shadow mask 21 is supported by the frame 22 such that the skirt portion 21*c* is fixed to the supporting wall 22*a* of the frame 22, there is a limit in compensating for the expansion of the mask plate 21*a*. Also, since the skirt portion 21*c* and the buffer groove 21*d* must be formed, the fabrication of the shadow mask frame assembly is burdensome and costly.

SUMMARY OF THE INVENTION

To solve the above problems, it is an objective of the present invention to provide a shadow mask frame assembly which can be easily fabricated and assembled and can effectively compensate for thermal expansion of a mask plate by eliminating a skirt portion thereof.

Accordingly, to achieve the above objective, there is provided a shadow mask frame assembly for a color cathode ray tube including a plate-shaped shadow mask formed with a plurality of electron beam passing holes and having a predetermined curvature, and a frame having a side wall, a flange inwardly extended from the side wall, and a supporting portion extended from the flange stepwise, wherein at least a part of the edges of the shadow mask is fixed to the supporting portion and unfixed edges of the shadow mask slip on the upper plane of the supporting portion during thermal expansion.

Also, the radius of curvature of the supporting portion corresponds to that of the shadow mask.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 3:
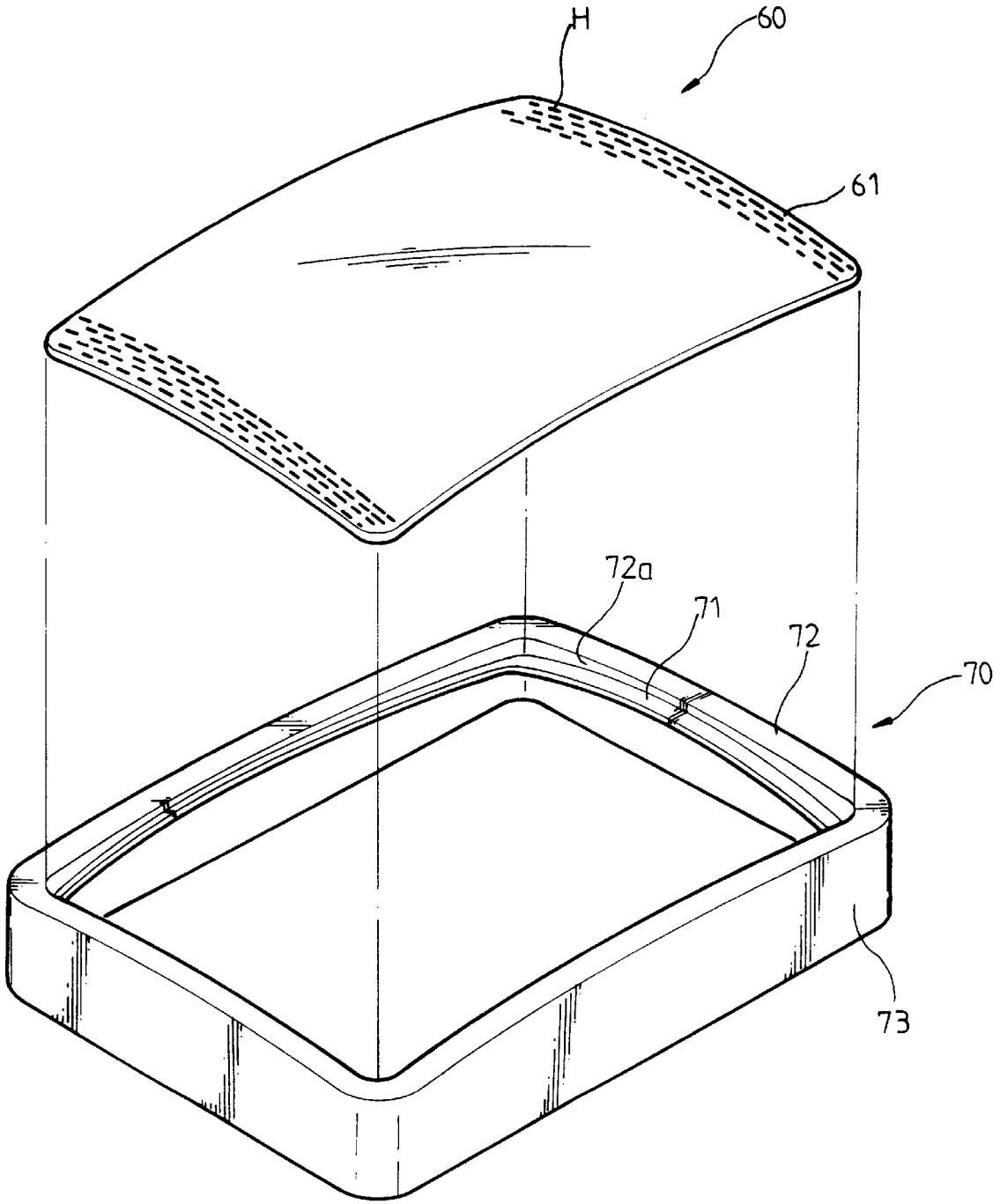
FIG. 3 is a partially exploded perspective view illustrating a shadow mask frame assembly according to the present invention.
Figure 4:
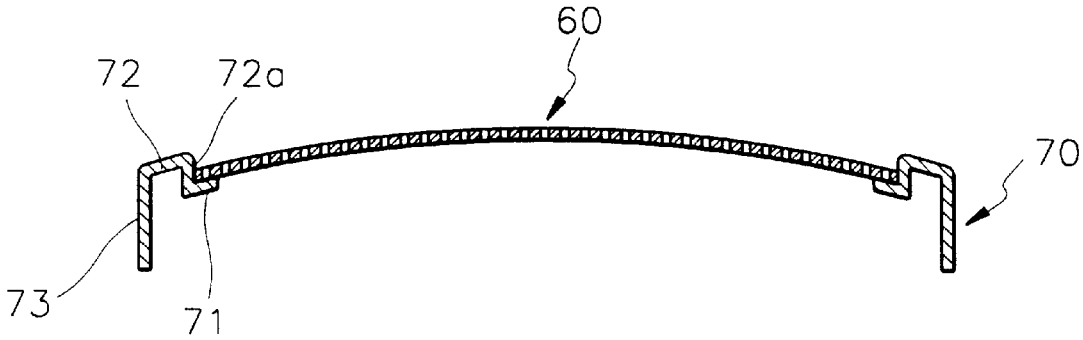
FIG. 4 is a sectional view of the shadow mask frame assembly according to the present invention.

FIGS. 3 and 4 show a shadow mask frame assembly for a color CRT according to an embodiment of the present invention.

Figure 1:
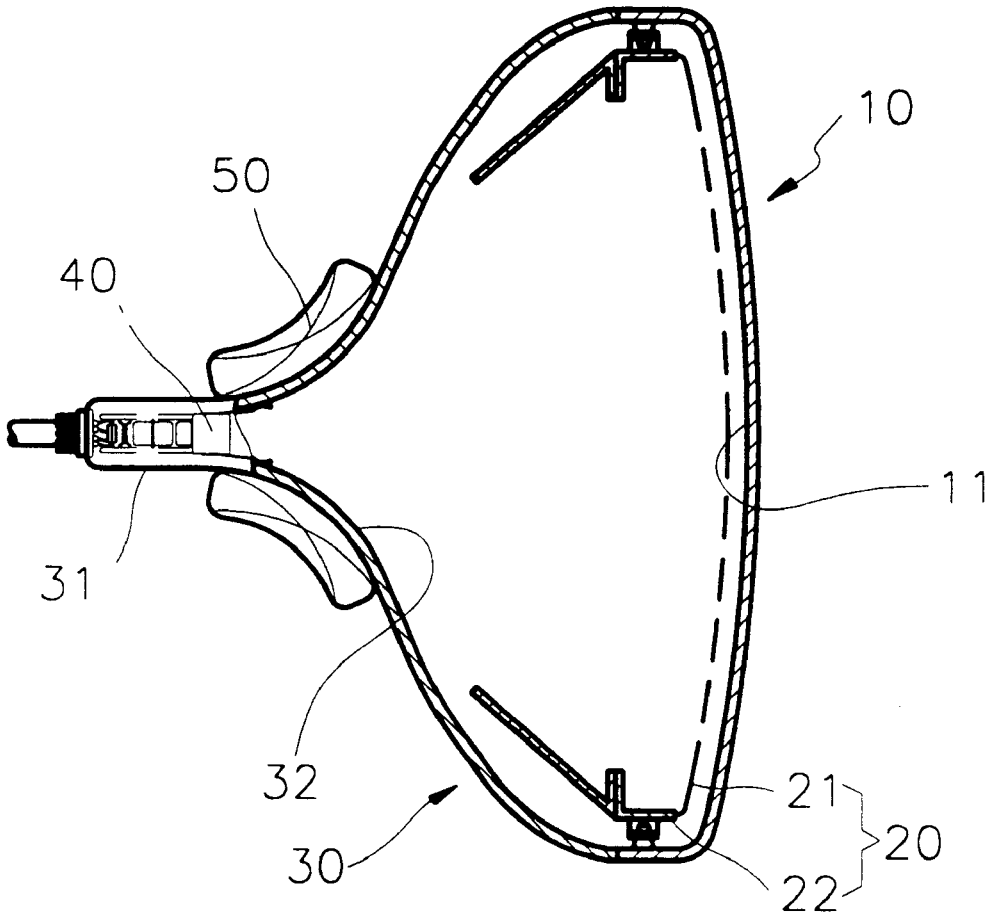
FIG. 1 (PRIOR ART)
FIG. 1 is a sectional view of a general color CRT.
Figure 2:
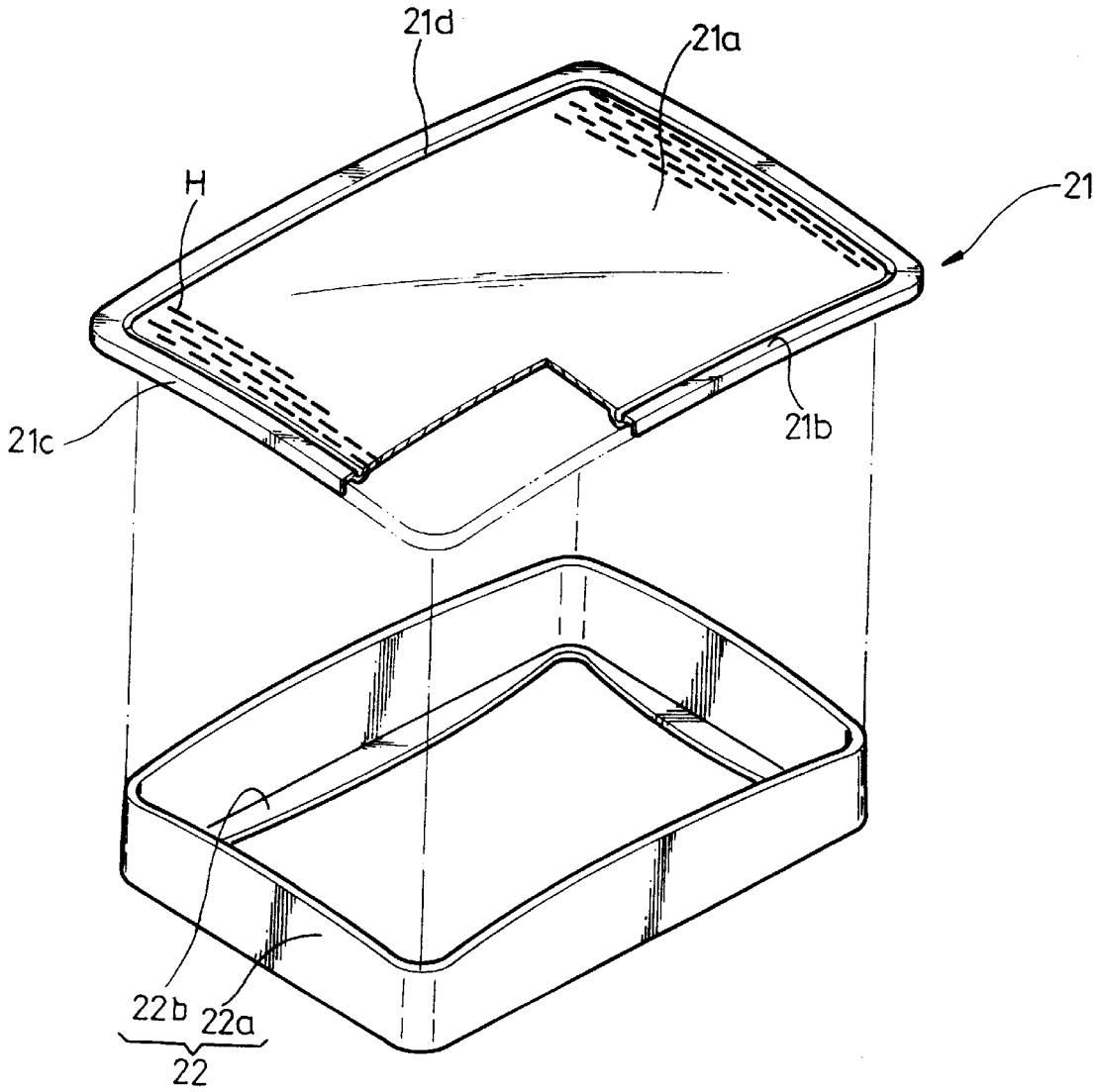
FIG. 2 (PRIOR ART)
FIG. 2 is a partially exploded perspective view illustrating a conventional shadow mask frame assembly.

Referring to FIGS. 3 and 4, the shadow mask frame assembly includes a shadow mask 60 and a frame 70 which are mutually coupled. The shadow mask 60, in which a plurality of electron beam passing holes H are formed, is a plate having a predetermined curvature. Unlike the conventional shadow mask 21 (FIG. 2), in the shadow mask 60 according to the present invention, a skirt portion (21*c* of FIG. 2) is not provided.

The shadow mask 60 may have different curvatures diagonally and horizontally/vertically. To flatten a panel, the radius of curvature of the shadow mask 60 is preferably made large.

The frame 70 includes a flange 72 inwardly extending from a side wall 73 and having a predetermined curvature, and a supporting portion 71 extending from the flange 72 and having a curvature corresponding to that of the shadow mask 60.

The radius of curvature of the supporting portion 71 is smaller than that of the flange 72. The supporting portion 71 and the flange 72 are connected by a connecting portion 72*a* a step.

The shadow mask 60 is fixed to the supporting portion 71 of the frame 70 with peripheral edges 61 welded thereto. In other words, the longer side portions or shorter side portions of the shadow mask 60 are selectively welded on the supporting portion 71.

As described above, since the peripheral edge 61 of the shadow mask 60 having a predetermined curvature is supported on the supporting portion 71 of the frame 70, it is easy to mount the shadow mask 60 on the frame 70. Also, since the longer side portions or the shorter side portions of the shadow mask 60 are selectively welded on the supporting portion 71, during thermal expansion of the shadow mask 60 due to impingement of electron beams, the unfixed longer side or shorter side portions expand freely while slipping outwardly from the upper plane of the supporting portion 71, thereby preventing doming.

According to the present invention, it is not necessary to form a skirt portion for fixing a shadow mask and a buffer groove for preventing the doming due to thermal expansion. Thus, it is easy to fabricate and assemble the shadow mask assembly.

Although the invention has been described with reference to particular embodiment thereof, it will be understood by those skilled in the art that the invention is capable of various alternative embodiments without departing from the spirit and scope of the invention as disclosed in the appended claims.

What is claimed is:

1. A shadow mask frame assembly for a color cathode ray tube comprising:

a plate-shaped shadow mask including a plurality of electron beam passing holes and having a curvature; and a frame having a side wall, a flange inwardly extending from the side wall, and a supporting portion extending from the flange as a step, wherein some edges of the shadow mask are attached to the supporting portion and some edges of the shadow mask are not attached to the supporting portion and slip on an upper surface of the supporting portion during thermal expansion of the shadow mask.

2. The shadow frame assembly according to claim 1, wherein the supporting radius has a curvature corresponding to the curvature of the shadow mask.

3. The shadow mask frame assembly according to claim 1, wherein the frame comprises a connecting portion, between the supporting portion and the flange, connecting the supporting portion to the flange, and resembling a stair step.

* * * * *